US006697590B2

(12) United States Patent
Inoue et al.

(10) Patent No.: US 6,697,590 B2
(45) Date of Patent: Feb. 24, 2004

(54) SHEET-LIKE OBJECT CONVEYING APPARATUS WITH MOVABLE BODY EXPOSING A CONVEYING PATH

(75) Inventors: Tatsuya Inoue, Nara (JP); Shinichi Takeda, Osaka (JP); Junya Masuda, Nara (JP); Masao Matsui, Tenri (JP); Koji Wakamoto, Nara (JP); Shinji Nakazawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/053,799

(22) Filed: Jan. 21, 2002

(65) Prior Publication Data

US 2002/0098010 A1 Jul. 25, 2002

(30) Foreign Application Priority Data

Jan. 22, 2001 (JP) ..... 2001-013603
Feb. 5, 2001 (JP) ..... 2001-028168

(51) Int. Cl.[7] ..... G03G 15/00
(52) U.S. Cl. ..... 399/124
(58) Field of Search ..... 399/21, 107, 110, 399/124, 125

(56) References Cited

U.S. PATENT DOCUMENTS 4,734,748 A * 3/1988 Murayama et al. ..... 399/124
5,802,426 A * 9/1998 Miyazaki et al. ..... 399/124 X
5,839,032 A * 11/1998 Yasui et al. ..... 399/124
5,897,244 A * 4/1999 Miyazaki et al. ..... 399/124 X
5,984,305 A 11/1999 Inoue ..... 271/291
6,134,404 A * 10/2000 Iwai et al. ..... 399/110
2002/0102110 A1 8/2002 Kida

FOREIGN PATENT DOCUMENTS

| | | |
|---|---|---|
| JP | 08-146689 | 7/1996 |
| JP | 10-148973 | 2/1998 |
| JP | 10-316294 | 2/1998 |

* cited by examiner

*Primary Examiner*—Sandra Brase
(74) *Attorney, Agent, or Firm*—Renner, Otto, Boisselle & Sklar

(57) ABSTRACT

There are provided a conveying path provided in an apparatus body and serving to convey a sheet-like object in a longitudinal direction, a moving body capable of being moved to a position in which the conveying path is to be exposed and a position in which the sheet-like object can be conveyed to cover the conveying path, and at least three support members for supporting the moving body to be slid in an almost horizontal direction with respect to the apparatus body and to be separated or joined are provided on a lower end portion at the side that a user accesses for a jam processing in the moving body and both upper and lower end portions at the opposite side thereof. Accordingly, in the case in which the user is to carry out the jam processing by separating the moving body from the apparatus body, a jammed paper in the conveying path can be removed easily.

5 Claims, 7 Drawing Sheets

SHEET-LIKE OBJECT CONVEYING APPARATUS WITH MOVABLE BODY EXPOSING A CONVEYING PATH

BACKGROUND OF THE INVENTION

1. Field of the Invention

The present invention relates to a sheet-like object conveying apparatus which is mainly provided in an image forming apparatus such as a copying machine, a printer or a facsimile and serves to convey a sheet-like object, more specifically, a plain paper, a transparent film for OHP and the like by means of a plurality of guide members.

2. Description of the Related Art

In the image forming apparatus such as a copying machine, a printer or a facsimile which comprises a sheet-like object conveying apparatus as a component, it is actually impossible to completely eliminate a jam of a paper to be a sheet-like object which is generated in a conveying path. For this reason, there have conventionally been proposed various image forming apparatuses constituted such that a user can process a jam generated in a paper conveying path in the apparatus, more specifically, the user can remove the jammed paper by his/her hand.

For example, Japanese Patent Application Laid-Open No. 10-316294 (1998) has disclosed an image forming apparatus in which when a jam is generated in an inversion path (a path for inverting a paper having an image formed on one of surfaces) provided side by side with a paper discharge section or an inversion paper discharging path, an inversion unit is pulled out from an apparatus body to expose a conveying path, thereby carrying out jam processing.

In the image forming apparatus disclosed in the Japanese Patent Application Laid-Open No. 10-316294 (1998), as shown in FIG. 1, an inversion unit 2U is slidably attached to an apparatus body 1 by means of two guide rails 201 and 202 provided on the front and rear face sides of the apparatus body 1. Accordingly, the inversion unit 2U is pulled out from the apparatus body 1 so that the inversion path and the inversion paper discharging path can be exposed.

In the structure of such a conventional image forming apparatus, when a jam is generated in the inversion path or the inversion paper discharging path, jam detecting means first detects the generation of the jam and the actuation of a machine is then stopped to inform a user of the generation of the jam. On the other hand, when the user knows the generation of the jam, an outer cover provided on the front face of the apparatus is opened and the inversion unit 2U is slid from the apparatus body 1 toward the side and is thus pulled out so that the inversion path or the inversion paper discharging path is exposed. Consequently, the jammed paper can be removed easily.

The inversion unit 2U of the above-mentioned conventional image forming apparatus is almost plate-shaped. On the other hand, the inversion unit 2U is pulled outward on the side of the apparatus body 1 by means of the two guide rails 201 and 202 provided in a direction which is almost perpendicular to a direction of a thickness of the inversion unit 2U on the front and rear face sides of the apparatus body 1. More specifically, the inversion unit 2U pulled out from the apparatus body 1 has a lower end portion supported on the two guide rails 201 and 202.

In a structure in which a pull-out member 2 such as a unit or a door is supported on the guide rails 201 and 202 and is pulled out from the apparatus body 1 in order to process the jam in the conveying path, however, in case a direction in which the pull-out member 2 is to be pulled out, that is, the longitudinal direction of the guide rail is almost orthogonal to the direction of the thickness of the pull-out member 2 to be pulled out from the apparatus body 1, a load (a moment) applied to a connecting portion of the pull-out member 2 and the guide rails 201 and 202 is not very great even if a downward external force F is applied to the pull-out member 2 for some reason as in the conventional art shown in FIG. 1, for example. With such a structure, the connecting portion of the pull-out member 2 and the guide rails 201 and 202 is formed to be comparatively long in a direction of extension of the guide rails 201 and 202.

On the other hand, as shown in FIG. 2, in the case in which a longitudinal door 101 to be a pull-out member is supported on a guide rail 102 and is pulled out from an apparatus body in an almost horizontal direction to expose a conveying path in order to carry out the jam processing of a longitudinal conveying system, the guide rail 102 is set to be almost parallel with the direction of the thickness of the pull-out body 101, for example. In this case, a connecting portion 103 of the guide rail 102 and the pull-out member 101 can be only formed to be short in the longitudinal direction of the guide rail 102. For this reason, when an external force is applied to the pull-out member 101, a very great load (moment) acts on the connecting portion 103 of the guide rail 102 and the pull-out member 101. Consequently, there is a possibility that the rail might be bent or might be broken in the worst case.

In an image forming apparatus in which a pull-out member such as a door is pulled out from an apparatus body to expose the interior of the apparatus in order to carry out the jam processing of a longitudinal conveying system, an inversion unit having a complicated structure is bulky because a functional component such as a gate for switching a destination of a sheet-like object is incorporated integrally therewith in many cases, which is not shown. Accordingly, if a support state (support structure) in which such an inversion unit is exposed is unstable, various troubles might be generated. For this reason, a countermeasure has been required to be taken.

For example, Japanese Patent Application Laid-Open No. 10-148973 (1998) has disclosed the structure of an image forming apparatus having a branching member for switching a conveying path provided in an inversion conveying portion for inverting and conveying a paper having an image formed on one of surfaces and having an openable door for exposing the inversion conveying portion when a jam generated in the inversion conveying portion is to be processed.

In the image forming apparatus disclosed in the Japanese Patent Application Laid-Open No. 10-148973 (1998), however, a switching gate to be one of movable branching members provided integrally with the openable door is held in a state in which an action attitude for the closing state of the door is exactly maintained with the door opened. More specifically, the tip portion of the switching gate is set in a state of upward protrusion.

In the conventional image forming apparatus above-mentioned, therefore, the switching gate is obstructive and dangerous during the jam processing. Therefore, it has been necessary to hold an extra space for avoiding the switching gate in order to maintain a sufficient space for jam processing. Accordingly, the outer dimension of the apparatus body is increased with the openable door opened. Consequently, the installation area of the image forming apparatus should be set to be large corresponding to the outer dimension so that a space cannot be saved on the user side.

In consideration of the above-mentioned problems, it is an object of the present invention to provide a sheet-like object conveying apparatus capable of easily carrying out the jam processing in a longitudinal conveying path.

Moreover, it is another object of the present invention to provide an image forming apparatus comprising a sheet-like object conveying apparatus constituted to have a conveying path switching branching member for switching a direction of conveyance of a paper which is provided in an openable door, the sheet-like object conveying apparatus having such a structure that the outer dimension of an apparatus body can be reduced when the openable door is opened and a space for jam processing in an inversion conveying portion can be sufficiently maintained to easily carry out a jamming work.

BRIEF SUMMARY OF THE INVENTION

In order to solve the above-mentioned problem, the present invention employs the following structure.

First of all, the present invention provides a sheet-like object conveying apparatus, comprising an apparatus body provided with, on one of side surfaces, a conveying path for conveying a sheet-like object in a longitudinal direction; and a moving body which is movable between a first position in which the moving body is to be joined with the apparatus body such that the sheet-like object can be conveyed to cover the conveying path and a second position apart from the apparatus body in order to expose the conveying path; wherein when the moving body is placed in the second position, at least one side portion close to an upper portion between the moving body and the apparatus body is brought into an open state.

According to such a structure, in the state in which the moving body is pulled out from the apparatus body to expose the conveying path, the upper end portion of a space formed between the apparatus body to be the side (one side) that a user accesses for a jam processing and the moving body is opened. Therefore, there is no obstacle to the jam processing and the jam processing can be carried out with a high workability.

Secondly, the present invention provides a sheet-like object conveying apparatus, comprising an apparatus body provided with, on one of side surfaces, a conveying path for conveying a sheet-like object in a longitudinal direction; a moving body which is movable between a first position in which the moving body is to be joined with the apparatus body such that the sheet-like object can be conveyed to cover the conveying path and a second position apart from the apparatus body in order to expose the conveying path; and a support member for supporting one of sides in which the other side in a direction orthogonal to a direction of movement of the moving body in a portion close to an upper portion of the moving body is to be brought into an open state and both sides in the direction orthogonal to the direction of the movement of the moving body in a portion close to a lower portion of the moving body respectively, and for causing the moving body to be moved in an almost horizontal direction between the first and second positions with respect to the apparatus body.

According to such a structure, the support member for supporting the moving body from the apparatus body is provided on the upper end portion as well as both lower end portions. Therefore, also in the case in which the moving body is placed in the second position set apart from the apparatus body, a stable support state can be maintained and the generation of troubles can be avoided even if an external force is carelessly applied to the upper part of the moving body. Moreover, it is also possible to prevent a looseness from being generated between the moving body and the apparatus body.

Furthermore, the consistency of the moving body and the apparatus body can be enhanced by employing the structure in which the support member is provided on both upper and lower sides as described above. Consequently, a functional component such as a paper guide member which is provided integrally with the moving body is accurately placed in a predetermined position on the apparatus body side when the moving body is joined with the apparatus body. Thus, a stable function can be guaranteed.

Moreover, the support member is not provided on the side (one side) that the user accesses for the jam processing, more specifically, an upper end portion at the front face side of the apparatus. In other words, a member to be an obstacle to the user is not present in an upper portion on this side of the apparatus. Accordingly, a large space is formed between the apparatus body and the moving body so that the interior of the apparatus is exposed. Consequently, a jammed paper can be removed easily and the workability of the jam processing can be enhanced.

In addition to the structure, thirdly, there is employed a structure in which a joining member to be provided on the moving body for joining the moving body to the apparatus body is disposed on the lower end portion at the jam processing access side (one side) of the moving body.

According to such a structure, the joining member with the apparatus body provided on the moving body is disposed on the lower end portion at the side that the user accesses for the jam processing in the moving body. Therefore, the joining member is not obstructive for the jam processing and the high workability of the jam processing can be expected.

Fourthly, the present invention provides a sheet-like object conveying apparatus, comprising an apparatus body provided with, on one of side surfaces, a conveying path for conveying a sheet-like object in a longitudinal direction; a moving body which is movable between a first position in which the moving body is to be joined with the apparatus body such that the sheet-like object can be conveyed to cover the conveying path and a second position apart from the apparatus body in order to expose the conveying path; and a support member for causing the moving body to be moved in an almost horizontal direction with respect to the apparatus body in at least three places including one place close to a lower portion on one side portion of the moving body which is required for a jam processing in the conveying path in a direction orthogonal to a direction of movement of the moving body in a portion close to an upper end of a space formed between the moving body and the apparatus body when the moving body is placed in the second position and two different places in a vertical direction of the other side portion excluding the side portion.

According to such a structure, the support member for supporting the moving body such as a door which is set in the open state is provided excluding an almost upper end portion on the side (one side) that user accesses for the jam processing in the moving body. Therefore, the support member of the moving body is not obstructive for the jam processing and the jam processing can be carried out easily.

In addition, the support member of the moving body is always provided on an almost lower end portion at the side that the user accesses for the jam processing in the moving body, and is provided in at least three places, that is, the almost lower end portion at the side that the user accesses for the jam processing in the moving body and the opposite side thereof. Therefore, a stable support state can be maintained so that the generation of troubles and looseness can be prevented.

Moreover, the consistency of the moving body and the apparatus body is excellent. Therefore, functional components such as a sheet guide member provided integrally with the moving body, the branching member of the conveying path and the like are accurately placed in the predetermined positions of the apparatus body when the moving body is joined with the apparatus body. Therefore, a stable function can be guaranteed.

Fifthly, the present invention provides the sheet-like object conveying apparatus, further comprising a branching member attached integrally with the moving body and serving to switch the conveying path, wherein the branching member can be operated interlockingly with the movement of the moving body to take such an attitude as to enlarge a space between the moving body and the apparatus body when the moving body is placed in the second position, and to take such an action attitude as to switch the conveying path when the moving body is placed in the first position in which the moving body is joined with the apparatus body.

According to such a structure, in the case in which the door is opened, that is, the moving body is placed in the second position, the branching member is set to take such an attitude as to enlarge a space between the moving body and the apparatus body, more specifically, such an attitude as to enlarge a space for jam processing. Therefore, it is possible to reduce the outer dimension of the apparatus body when the door is opened. Accordingly, a sufficient space for jam processing can be maintained without requiring a large space for the installation of the apparatus body and the workability of the jam processing can be enhanced.

Sixthly, the present invention provides the sheet-like object conveying apparatus, further comprising a branching member side abutting member provided in the branching member; and a body side abutting member provided in the apparatus body, whereby the branching member side abutting member abuts on the body side abutting member interlockingly with the movement of the moving body to the first position so that the branching member takes the acting attitude when the moving body is placed in the second position.

According to such a simple structure, the branching member can be caused to automatically take an action attitude when closing the door.

Seventhly, the present invention provides the sheet-like object conveying apparatus, wherein the branching member takes such an attitude as to enlarge the space formed between the moving body and the apparatus body by a self-weight thereof when the moving body is placed in the second position.

According to such a simple structure, the space for jam processing is automatically enlarged when the door is opened.

Eighthly, the present invention provides the sheet-like object conveying apparatus, wherein the branching member side abutting member and the body side abutting member are provided on the other side of the apparatus body.

According to such a structure, the branching member side abutting member and the body side abutting member are not obstructive to the jamming work for the jam processing. Therefore, the workability of the jam processing can be enhanced still more.

The above and further objects and features of the invention will more fully be apparent from the following detailed description with accompanying drawings.

DETAILED DESCRIPTION OF THE PREFERRED EMBODIMENTS

An embodiment of a sheet-like object conveying apparatus according to the present invention will be described below with reference to the drawings showing the case in which the sheet-like object conveying apparatus is applied to a paper conveying apparatus of an image forming apparatus.

Figure 1:
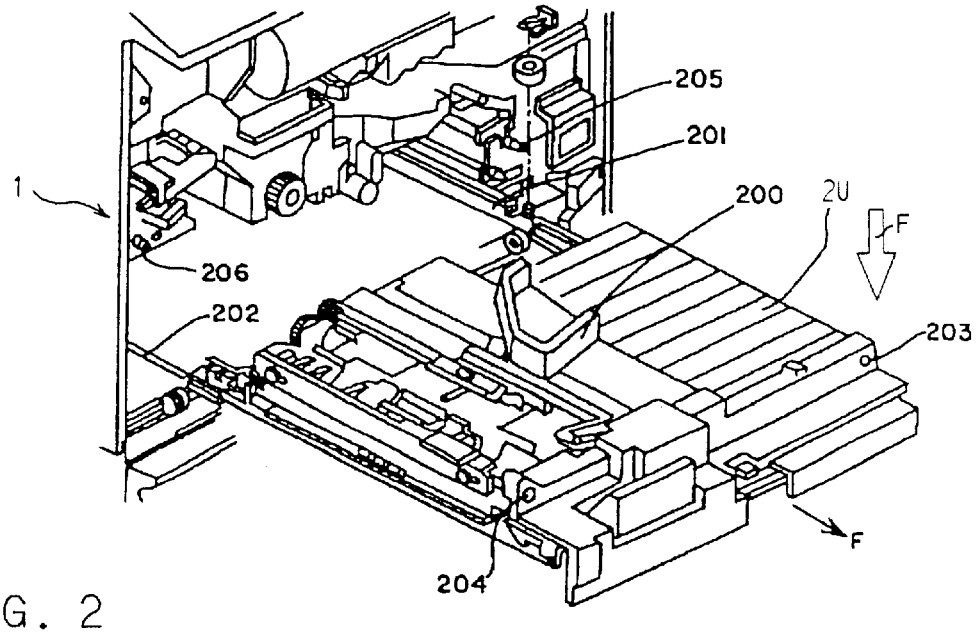
FIG. 1 PRIOR ART
FIG. 1 is a perspective view showing an example of a state in which the pull-out member of a conventional image forming apparatus is pulled out.
Figure 2:
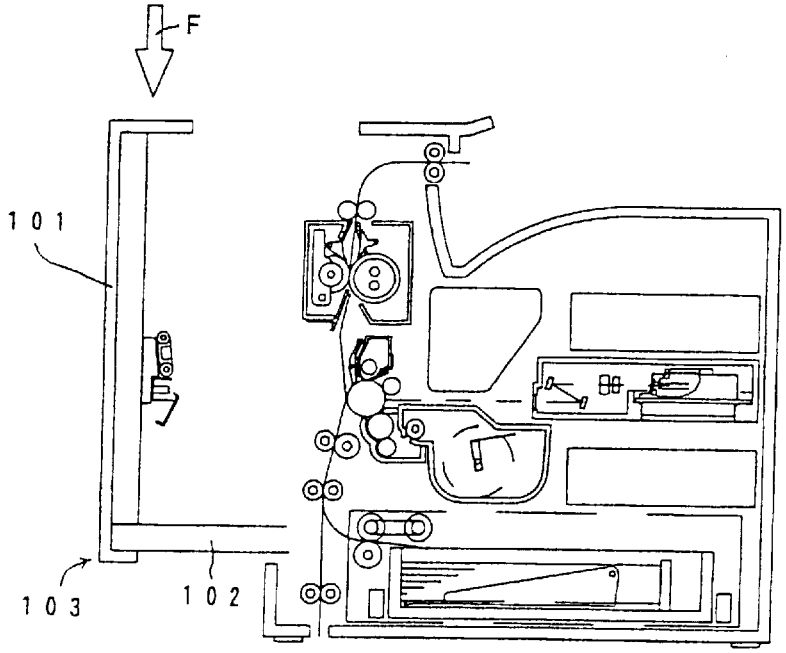
FIG. 2 PRIOR ART
FIG. 2 is a perspective view showing another example of the state in which the pull-out member of the conventional image forming apparatus is pulled out.
Figure 3:
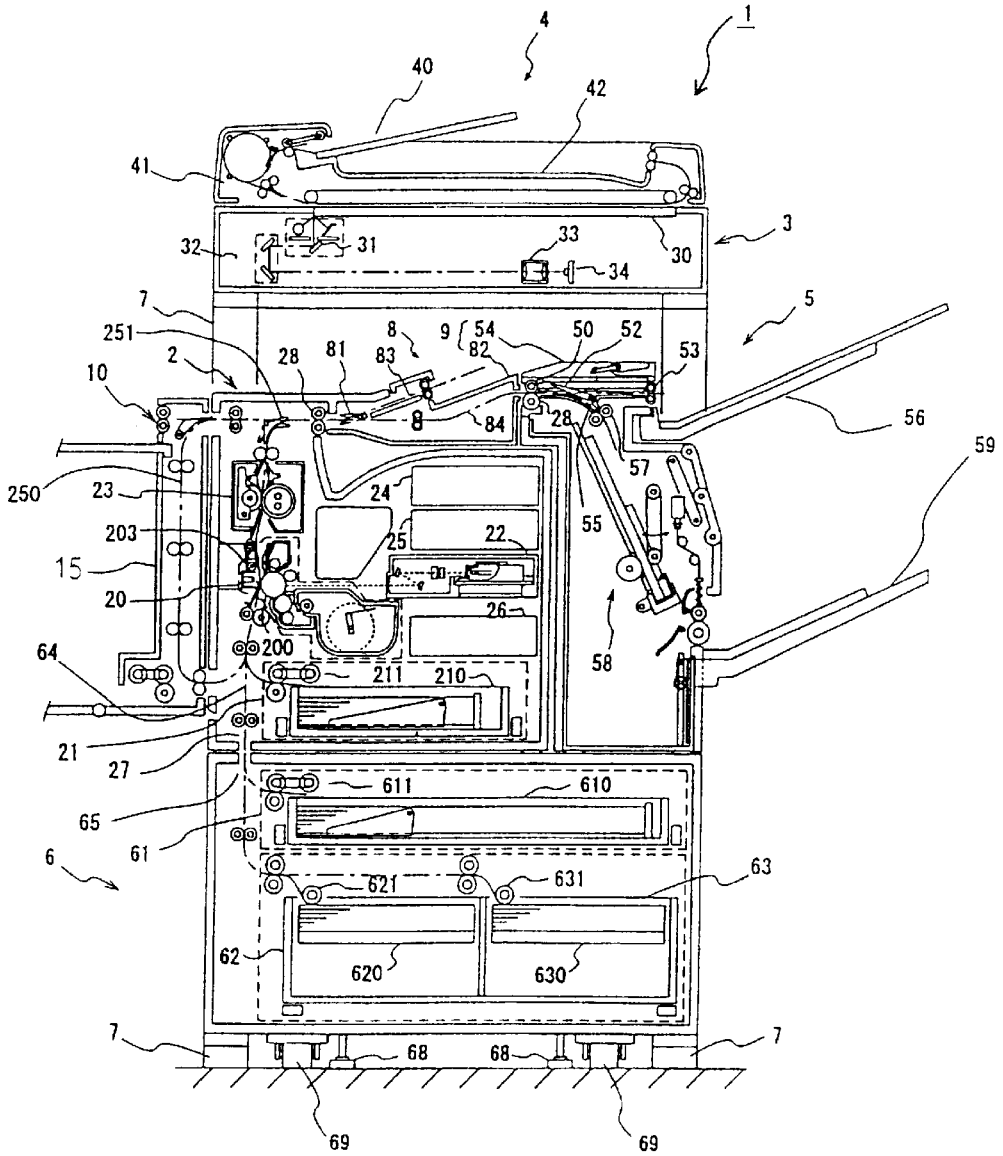
FIG. 3 is a longitudinal sectional view showing an image forming apparatus comprising a paper conveying apparatus according to an embodiment of a sheet-like object conveying apparatus of the present invention.

FIG. 3 is a longitudinal sectional view showing an image forming apparatus 1 comprising a paper conveying apparatus according to an embodiment of the sheet-like object conveying apparatus of the present invention. In the image forming apparatus 1, a scanner 3, an automatic document feeder (which will be hereinafter referred to as an ADF) 4, a sheet postprocessing unit 5, a multistage paper feed unit 6, an interexchange conveying unit 8 and a double side conveying unit 10 are connected by using a printer 2 to be a nucleus, and a function is extended.

The scanner 3 is supported on a system rack 7 together with the ADF 4 provided on an upper portion thereof, and is disposed above the printer 2 and the sheet postprocessing unit 5. The printer 2 records and outputs an image read by the scanner 3, and furthermore, records and outputs image data sent from external connecting equipment in the case in which the external connecting equipment, for example, an image processing apparatus such as a personal computer is connected.

In the printer 2, an electrophotographic process unit 20 mainly including a drum-shaped photosensitive body 200 is provided on the almost central left side of an apparatus body. A paper feed unit 21 provided in the printer 2 body is disposed on the lower side of the printer 2 body. The paper feed unit 21 is constituted by a paper feed tray 210 for accommodating a paper and separating and feeding means 211 for separating and feeding, one by one, papers accommodated in the paper feed tray 210.

The papers separated and fed from the paper feed unit 21 one by one are sequentially supplied between the photosensitive body 200 of the electrophotographic processing unit 20 and a transfer unit 203 and an image recorded and reproduced on the photosensitive body 200 is transferred thereto. The paper is supplied to the paper feed unit 21 by pulling out the paper feed tray 210 toward the front side of the print 2 body.

The lower surface of the printer 2 body is provided with a paper inlet 27 for receiving a paper fed from the multistage paper feed unit 6 prepared as peripheral equipment and the like and for sequentially feeding the paper between the photosensitive body 200 of the electrophotographic process unit 20 and the transfer unit 203.

A fixing unit 23 is provided above the electrophotographic process unit 20. The fixing unit 23 sequentially receives a paper having an image transferred thereto, heats and fixes a developer transferred onto the paper and feeds the paper. The paper having an image recorded thereon is transferred from a discharge roller 28 of the printer 2 to the interexchange conveying unit 8 provided on the upper surface of the printer 2 body.

The upper and lower space portions of an optical scanning unit 22 are provided with a printer control unit 24 for accommodating a process control unit (PCU) board for controlling an electrophotographic process and an interface board for receiving image data from the outside of the apparatus, an image control unit 25 comprising an image control unit (ICU) board for carrying out a predetermined imaging process over the image data received from the interface board and for scanning and recording an image by means of the optical scanning unit 22, a power supply unit 26 for supplying a power to various boards and the units, and the like.

The multistage paper feed unit 6 is a built-on paper feed unit, and has three paper feed units 61, 62 and 63. Papers accommodated in paper feed trays 610, 620 and 630 of the paper feed units 61, 62 and 63 are separated one by one through separating and feeding means 611, 621 and 631 and are supplied toward a paper outlet 65 provided on the upper surface of the multistage paper feed unit 6 and communicating with a paper inlet 27 of the printer 2.

In the present embodiment, the paper feed units 61, 62 and 63 accommodating papers having desired sizes are selectively operated during actuation. The paper is supplied to the paper feed units 61, 62 and 63 by pulling out the paper feed trays 610, 620 and 630 toward the front side of the unit body and papers having the same size are accommodated in the paper feed units 62 and 63.

Moreover, the multistage paper feed unit 6 is constituted to mount the printer 2 and the postprocessing unit 5 on an upper portion thereof, and comprises a traveling roller 69 and a screw type fixing member 68 on a lower portion thereof such that it can be moved in this state and can be fixed and disposed onto the system rack 7. If the fixing member 68 is rotated and raised and is thereby separated from a floor surface, the multistage paper feed unit 6 can be moved. Moreover, if the fixing member 68 is rotated and brought down in a reverse direction and is thereby caused to come in contact with the floor surface, the multistage paper feed unit 6 can be fixed.

While the structure in which the three paper feed units 61, 62 and 63 are provided is employed in the present embodiment, the present invention is not restricted thereto but a plurality of paper feed units to accommodate papers having the same size are preferably provided including the paper feed unit 21.

The sheet postprocessing unit 5 serves to introduce a paper having a recorded image which is discharged from the interexchange conveying unit 8 or the printer 2 through a conveying roller 50 in the upper part of the sheet postprocessing unit 5, and to carry out a postprocessing over the paper. The sheet postprocessing unit 5 serves to carry out a staple processing, is provided side by side with the printer 2 and has a conveying roller pair 50 for introducing a paper on which image recording is completed in the printer 2.

The downstream side in the paper discharge direction of the conveying roller pair 50 is provided with a switching gate 52 for selectively switching a conveying path for a paper into a conveying path 53 which does not carry out the staple processing and a conveying path 55 connected to a staple processing unit 58 according to a mode specified by a user.

The paper conveyed into the conveying path 53 by the guide of the switching gate 52 is not processed but is discharged onto a paper discharge tray 56 in an upper stage by the action of a paper discharging roller pair 55. On the other hand, the paper conveyed into the conveying path 55 by the guide of the switching gate 52 is led into the staple processing unit 58 by the conveying roller pair 57 provided on the conveying path 55. The paper subjected to the staple processing is discharged to a paper discharge tray 59 in a lower stage.

The scanner 3 comprises an automatic reading mode in which sheet-shaped documents are automatically fed through the ADF 4 and are sequentially exposed and scanned one by one to read a document image, and a manual reading mode in which a book-like document or a sheet-like document which cannot be automatically fed through the ADF 4 is set by a manual operation to read an original image.

The image of the document mounted on a transparent document table 30 is exposed and scanned through a first scanning unit 31 and a second scanning unit 32 which are mutually moved along the document table 30 with a predetermined speed relationship. The result of the scan is led through an optical component such as a mirror or an image forming lens 33, and an image is formed on a photoelectric converting element 34 so that a document image is converted into an electric signal to be output.

The ADF 4 comprises document conveying means 41 for conveying the document mounted on a document set tray 40 toward the document table 30 and for discharging the scanned document onto the document discharge tray 42. Moreover, this side of the apparatus is exposed with an upward rotation by setting the inner side of the apparatus to be a fulcrum such that the sheet-like document which cannot be automatically fed is mounted on the document table 30 and can be scanned.

The interexchange conveying unit 8 is attached onto the upper portion of the discharge tray 9 provided on the top of the printer 2, and serves to introduce a paper having a recorded image discharged from the printer 2 toward the sheet postprocessing unit 5 positioned on the downstream side of the printer 2.

Moreover, another paper conveying path 83 for leading the paper to the discharge tray 9 formed by an upper surface 82 of the interexchange conveying unit 8 and an upper surface 54 of the sheet postprocessing unit 5 branches off in the middle of a paper conveying path 84 of the interexchange conveying unit 8. Two discharge destinations can be changed by switching a gate 81 provided in the branch portion of the conveying path.

The discharge tray 9 is also used for a paper inversion conveying path and implements image formation on both sides of the paper together with the external installed double side conveying unit 10 (integral with the door 15 to be the openable moving body). For this reason, the discharge roller 28 is rotatable in normal and reverse directions. The conveying path 64 provided from the paper feed units 21, 61, 62 and 63 to the electrophotographic process unit 20 and the fixing unit 23 is provided with a gate 251 on the downstream side of the fixing unit 23.

The paper fixed completely is discharged to the sheet postprocessing unit 5 or the discharge tray 9 if the gate 251 is switched to the side shown in a solid line of FIG. 3. In the case in which the discharge tray 9 is used as an inversion conveying path as described above, the paper is returned and is inverted and conveyed to the conveying path 250 through the gate 251 switched to the side shown in a broken line of FIG. 3. Thus, an image can be formed on both sides of the paper.

Next, description will be given to a jam processing mechanism in the conveying path 64 (a conveying path of a longitudinal conveying system) provided from the paper feed units 21, 61, 62 and 63 to the electrophotographic process unit 20 and the fixing unit 23, which is a feature of the present invention.

Figure 4:
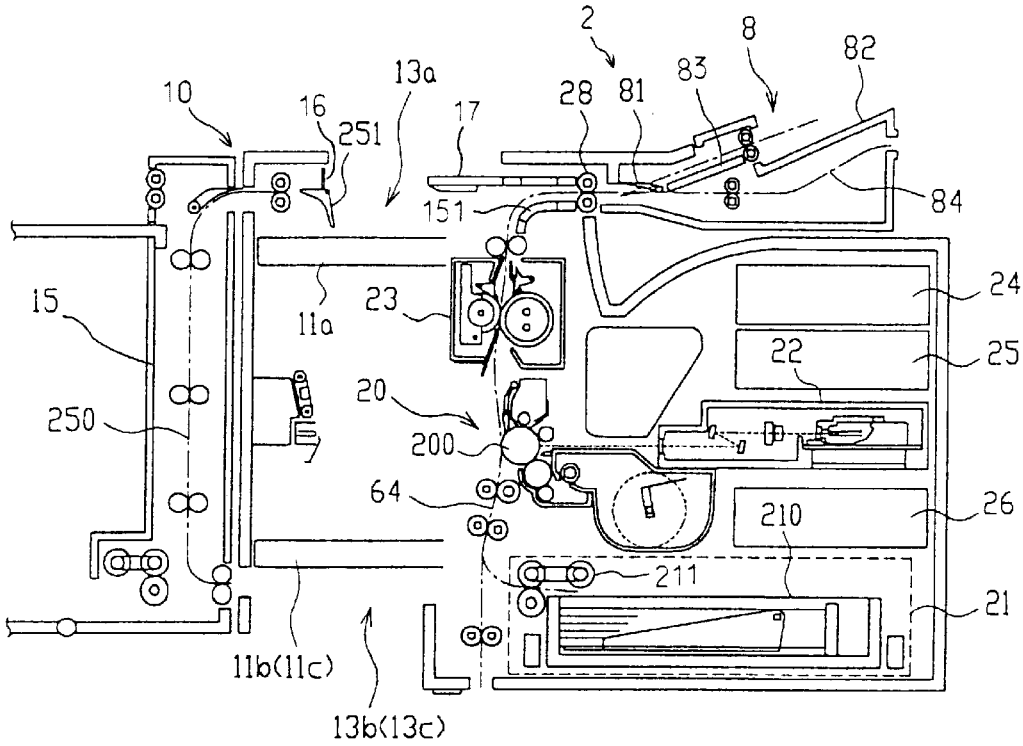
FIG. 4 is a sectional view showing the essential portion of the image forming apparatus in a state in which an openable door is opened.
Figure 5:
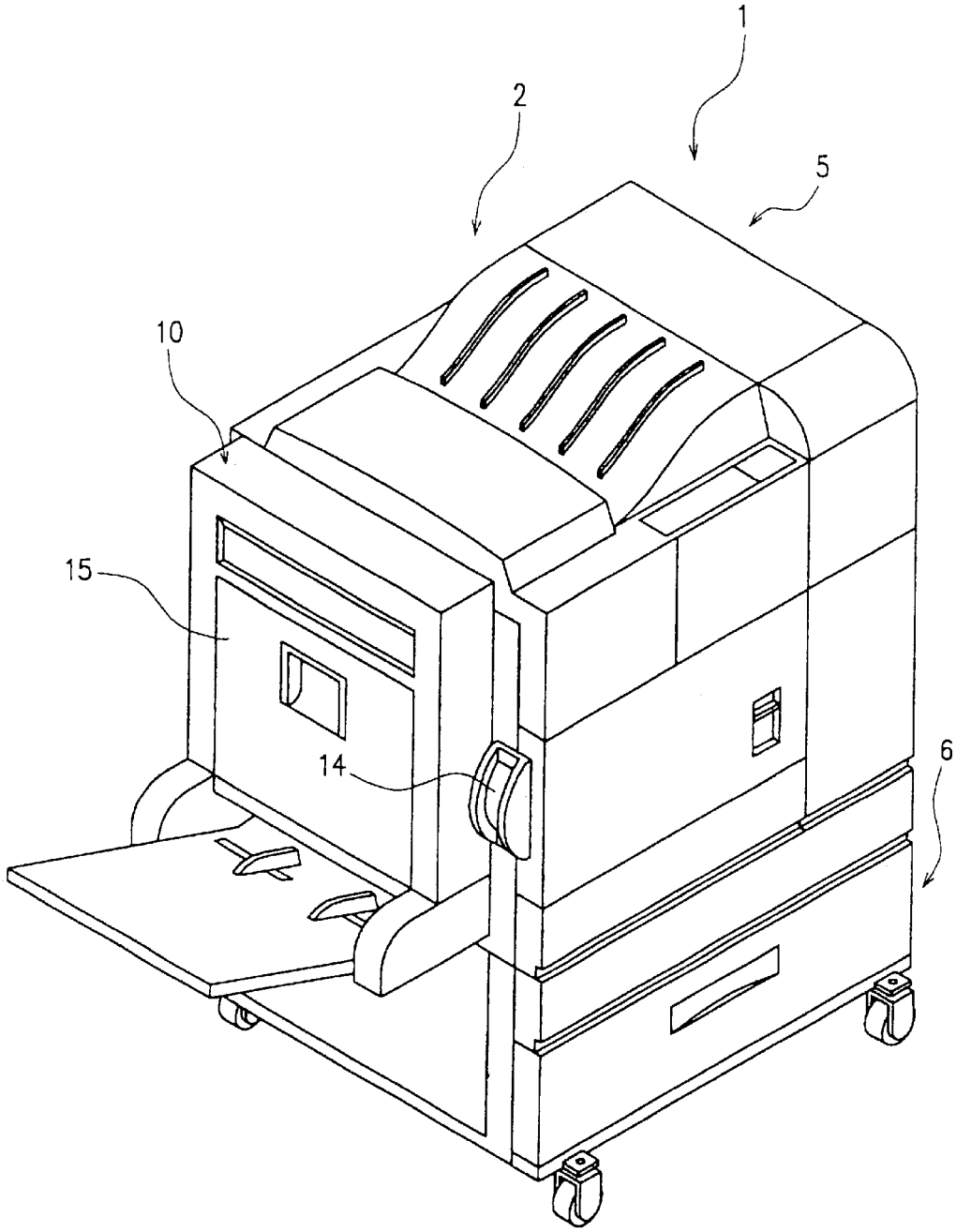
FIG. 5 is a perspective view showing the image forming apparatus in a state in which the openable door is closed.
Figure 6:
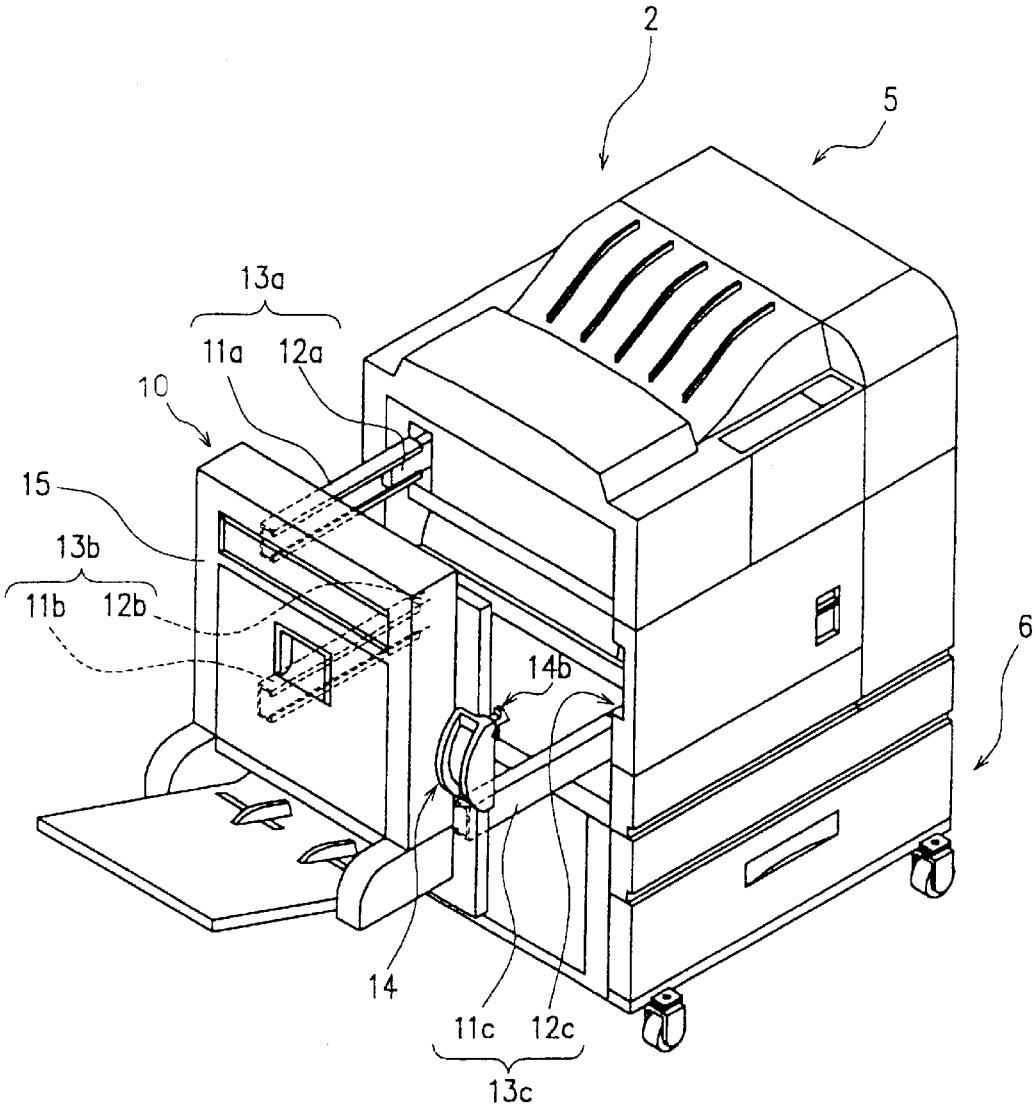
FIG. 6 is a perspective view showing the image forming apparatus in the state in which the openable door is opened.

FIG. 4 is a sectional view showing a state in which the openable door 15 integral with the double side conveying unit 10 is opened, FIG. 5 is a perspective view showing a state in which the door 15 is closed, and FIG. 6 is a perspective view showing a state in which an unlocking lever 14 is released and the door 15 is opened. FIG. 4 shows only the printer 2 and the double side conveying unit 10 and FIG. 5 and FIG. 6 show another structure excluding the scanner 3 and the ADF 4.

As shown in FIG. 4 and FIG. 6, the double side conveying unit 10 integrated with the door 15 is slidably attached to the printer 2 body, that is, the apparatus body by means of three slide guides (support members) 13*a*, 13*b* and 13*c*. Therefore, the conveying path 64 to be a conveying path in a longitudinal direction can be exposed. In the state in which the door 15 is opened (is placed in a second position), the jam processing can be carried out easily and rapidly.

The slide guide 13*a* (or 13*b*, 13*c*) is constituted by a guide rail 11*a* (or 11*b*, 11*c*) having an end portion fixed to the double side conveying unit 10, and a slider 12*a* (or 12*b*, 12*c*) having an U-shaped section which is provided on the printer 2 body, that is, the apparatus body slidably and extendably in a horizontal direction and is fitted in the guide rail 11*a* (or 11*b*, 11*c*).

The guide rail and the slider are provided in the following positions, respectively. The guide rail 11*a* and the slider 12*a* are provided on an upper end portion at the rear face side of the printer 2 body (the other side in a direction orthogonal to a direction of movement of the moving body in a portion close to the upper portion of the moving body in which the door 15 and the double side conveying unit 10 are integrated with each other), the guide rail 11*b* and the slider 12*b* are provided on a lower end portion at the rear face side of the printer 2 body, and furthermore, the guide rail 11*c* and the slider 12*c* are provided on a lower end portion at the front face side of the printer 2 body (one of sides in the direction orthogonal to the direction of the movement of the moving body in the portion close to the upper portion of the moving body in which the door 15 and the double side conveying unit 10 are integrated with each other). The front face side (one of the sides) is a jam processing side (an access side) and the rear face side (the other side) is the opposite side of the jam processing.

When the guide rails 11*a*, 11*b* and 11*c* integral with the double side conveying unit 10 (and the door 15) are guided and slid in the horizontal direction by means of the sliders 12*a*, 12*b* and 12*c* respectively, the double side conveying unit 10 (and the door 15) is slid and moved with respect to the printer 2 body, that is, the apparatus body so that the conveying path 64 is opened or closed. The double side conveying unit 10 (and the door 15) is set in such a condition that a state in which the printer 2 body, that is, the apparatus body is closed is placed in a first position.

By the above-mentioned structure, in the case in which the conveying path 64 to be the longitudinal conveying system is exposed in order to remove a jammed paper generated in the conveying path 64, the door 15 integral with the double side conveying unit 10 is pulled out and is placed in the second position to expose the interior of the apparatus. The double side conveying unit 10 thus pulled out is supported on the slide guide 13*a* provided on the upper end portion at the rear face side as well as the two slide guides 13*b* and 13*c* on the lower end portions at the rear and front face sides as described above.

Accordingly, support strength is stabilized to be high three-dimensionally. Even if an external force is carelessly applied to the upper part of the double side conveying unit 10 which is maintained to be pulled out, the double side conveying unit 10 can maintain a stable support state so that the generation of troubles can be prevented.

Moreover, the slide guide 13*a* is also provided on the upper end portion of the double side conveying unit 10 as described above. Consequently, the consistency of the double side conveying unit 10 to be pulled out and the apparatus body can be enhanced remarkably. Accordingly, even if the double side conveying unit 10 is slid, looseness is caused with difficulty. When the door 15 is closed, the double side conveying unit 10 can be accurately accommodated in a proper position with respect to the apparatus body.

Furthermore, the slide guide is not provided on the upper end portion at the access side in which the user is to carry out the jam processing, that is, the upper end portion at the front face side of the apparatus. Therefore, the user can easily insert his/her hand into the apparatus from above on this side, thereby removing the jammed paper. Thus, the workability of the jam processing can be enhanced. In other words, the upper end portion on the access side for the jam processing is opened. Therefore, there is no obstacle to the jam processing and the jam processing work can easily be carried out.

Moreover, the unlocking lever 14 is provided in a lower position on the front face side of the printer 2 body. Therefore, the joining member 14*b* with the body of the unlocking lever 14 is not obstructive to the jam processing and the excellent workability of the jam processing can be prevented from being deteriorated.

In the above-mentioned structure of the image forming apparatus 1 in which the openable door 15 and the bulky double side conveying unit 10 are moved as the integral moving body, the stability of support for opening the door 15 can be enhanced effectively and the jam processing work can easily be carried out, and furthermore, the excellent consistency can be maintained between the moving body (the door 15 and the conveying unit 10) to be a movable portion and the body side, thereby reducing the generation of troubles.

Moreover, the image forming apparatus 1 is provided with an interlock switch, which is not shown. When the double side conveying unit 10 is opened, the interlock switch is first turned OFF and the apparatus body side and the connector of the double side conveying unit is then disconnected from each other. On the other hand, when the double side conveying unit 10 is closed, the apparatus body side and the connector of the double side conveying unit are first connected to each other and the interlock switch is then turned ON.

Also in the structure in which the interlock switch is thus provided to slide an electrical component integrally with the door 15, stability can be enhanced still more during the jam processing.

Under the condition that the upper end portion at the access side for the jam processing is opened, three or more support members may be provided in order to enhance support strength for the door 15 depending on a type, which is not shown. In the present invention, moreover, the support structure of the moving body is not restricted to the embodiment (a slide guide type) but the support member may be of a link type or the like, for example. If at least the upper end portion on the access side for the jam processing is opened, the link type may be properly employed irrespective of the structure.

Next, description will be given to a structure in which a space for jam processing in the inversion conveying portion can be sufficiently maintained with the openable door 15 opened in the gate 251 to be the conveying path switching branching member for switching the direction of conveyance of the paper, which is a further feature of the present invention.

As shown in FIG. 4, in the present embodiment, the openable door 15 (which will be hereinafter referred to as a movable member together with the door 15 and the double side conveying unit 10) with which the double side conveying unit 10 is integrated is constituted slidably in the horizontal direction with respect to the apparatus body by means of the slide guides 13*a*, 13*b* and 13*c* and the conveying path 64 can be exposed.

Figure 7:
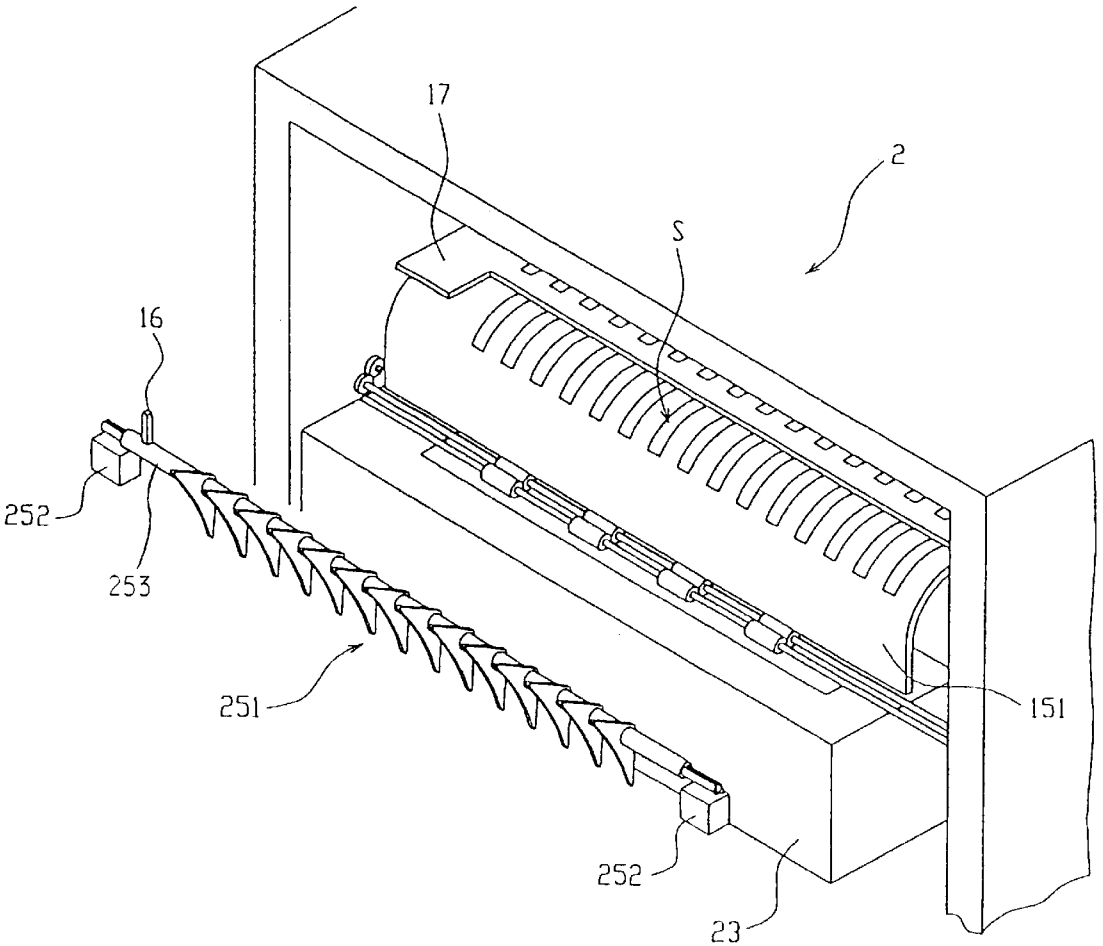
FIG. 7 is a perspective view showing a state of correspondence of a branching member on the openable door side and an apparatus body.

As shown in FIG. 7, furthermore, the gate 251 has both end portions of a spindle 253 rotatably supported on a bearing portion 252 provided in two places in an inner direction of the printer 2 body in the door 15. The spindle 253 of the gate 251 is fitted in the bearing portion 252 in a state in which the door 15 is opened. The bar-shaped branch gate side abutting member (branching member side abutting member) 16 is fixed to the portion on the rear face side of the printer 2 body of the spindle 253 of the gate 251 orthogonally to the central axis of the spindle 253 with a protruding state in an almost upward direction in the state in which the door 15 is opened.

On the other hand, the flat-shaped body side abutting member 17 is provided on the apparatus body side corresponding to the branch gate side abutting member 16 in order to rotate the gate 251 in a counterclockwise direction in the drawing in abutment on a portion at the tip portion side of the branch gate side abutting member 16 in the case in which the door 15 is closed.

The reference numeral 151 denotes a paper guide provided on the apparatus body side and has a plurality of slits S into which the tip portion of the gate 251 is inserted during the rotation (at branch switching) of the gate 251.

Description will be given to the relative positional relationship between the branch gate side abutting member 16 and the body side abutting member 17 during the opening and closing operations of the door 15 and the rotation state of the gate 251 with reference to FIG. 8A to FIG. 8D typically showing them.

Figure 8A:
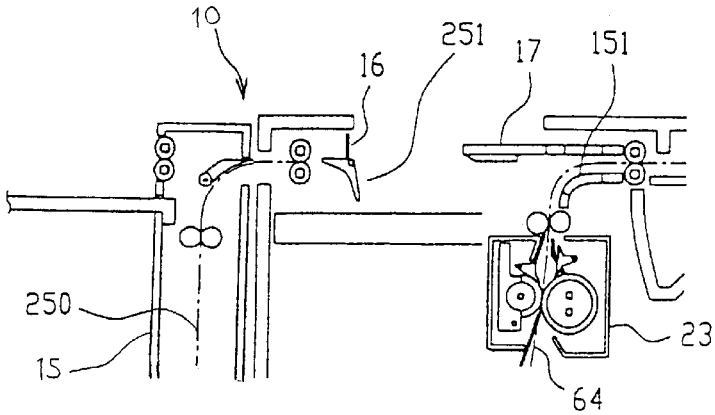
FIG. 8A to FIG. 8D are typical views showing a state of a change in the attitude of the branching member.

FIG. 8A shows a state in which the door 15 is completely opened with respect to the apparatus body. In the state in which the door 15 is completely opened, the gate 251 is rotated in a clockwise direction in the drawing by setting the spindle 253 to be a center by a self-weight thereof, and one of tip portions (more specifically, the printer 2 body side) is inclined downward to have such an attitude as to enlarge an open space, that is, a space for jam processing. In other words, in such an attitude, the gate 251 is not obstructive when the user inserts his/her hand from above the apparatus body (in this case, since the other tip portion of the gate 251 is turned toward the inside of the door 15, the gate 251 is not obstructive). Accordingly, the outer dimension of the apparatus body can be reduced and a large space is not required for the installation of the apparatus body.

Figure 8B:
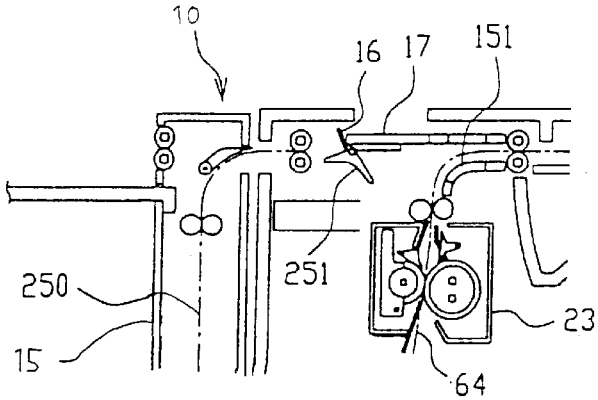

In FIG. 8B, the door 15 is slightly moved toward the apparatus body side from the completely open state. In such a state, the branch gate side abutting member 16 provided on the door 15 abuts on the body side abutting member 17. When the door 15 is slid to this position, the body side abutting member 17 presses the branch gate side abutting member 16 in a reverse direction to the direction of the movement of the door 15. Therefore, the gate 251 is slightly rotated counterclockwise in the drawing around the spindle 253.

Figure 8C:
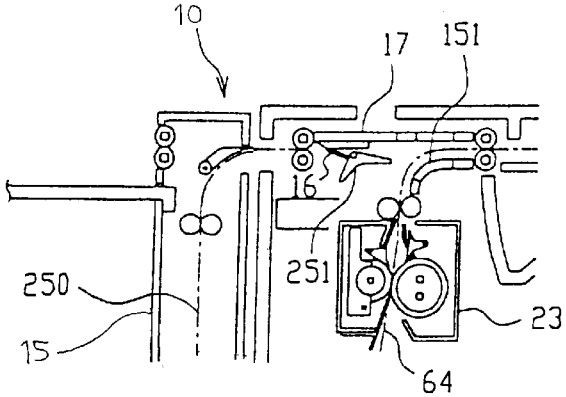
Figure 8D:
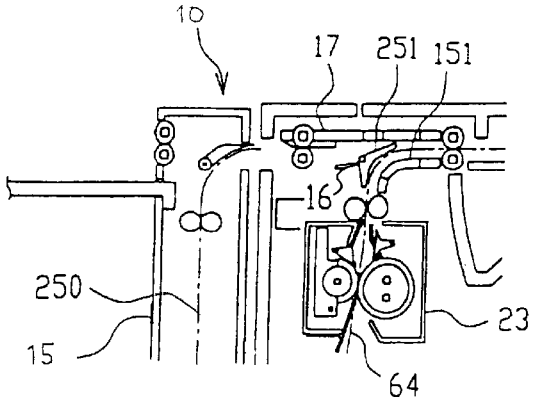

When the door 15 is slid in a further closing direction, that is, toward the apparatus body side in this state, the gate 251 is further rotated along the paper guide 151 provided on the paper conveying path 64 as shown in FIG. 8C. In the state in which the door 15 is completely closed, the gate 251 is maintained completely along the paper guide 151, that is, is set to take such an action attitude as to implement the branch function to branch the conveyed paper as shown in FIG. 8D. In the state shown in FIG. 8D, the gate 251 is held to take a predetermined attitude by means of an attitude control mechanism which is not shown.

As described above, when the door 15 is opened, the gate 251 to be moved integrally with the door 15 is rotated in such a direction as to enlarge the space for jam processing around the spindle 253 by a self-weight thereof (one of the tip portions turned toward the inside of the apparatus body is rotated in a downward direction in the action attitude). Consequently, the gate 251 is not obstructive to the jam processing. Therefore, the sufficient space for jam processing can be maintained without unnecessarily opening the door 15. Thus, it is possible to enhance the workability of the jam processing without enlarging the installation space of the image forming apparatus. In other word, it is possible to easily carry out the jam processing without largely opening the door 15.

As described above, furthermore, it is sufficient that the branch gate side abutting member 16 and the body side abutting member 17 are provided in the door 15 and the apparatus body respectively for the structure in which the gate 251 is to be rotated to take the action attitude along the paper guide 151 when closing the door 15. Thus, the structure can be simplified and a cost can be reduced.

In addition, since both the branch gate side abutting member 16 and the body side abutting member 17 are provided on the opposite side of the jam processing access side of the apparatus body as shown in FIG. 7, they are not obstructive to the jam processing work. In FIG. 7, this side is set to be the jam processing access side.

As is apparent from the above description, the present invention has the following effects.

In a state in which the moving body is pulled out from the apparatus body and the conveying path for the sheet-like object is exposed, the upper end portion on the jam processing access side is opened. Therefore, there is no obstacle to the jam processing. Consequently, the jammed paper can easily be removed and the jam processing can be carried out with a high workability.

The support member for supporting the moving body in the open state is provided on the upper end portion as well as both lower end portions. Therefore, even if an external force is carelessly applied to the upper portion of the moving body when the moving body is opened, the stable support state can be maintained and the generation of troubles can be avoided. Moreover, looseness can be prevented from being generated.

Furthermore, since the support members are provided on both upper and lower sides as described above, the consistency of the moving body and the apparatus body can be enhanced. Consequently, a functional component such as a guide member provided integrally with the moving body is accurately placed in a predetermined position on the apparatus body side when the moving body is closed. Thus, a stable function can be maintained.

Moreover, the support member is not provided on the upper end portion at the side (apparatus front face side) that the user accesses for the jam processing. Accordingly, a space is formed in the upper portion at this side of the apparatus for the user so that the interior of the apparatus is largely opened and exposed. Consequently, the jammed paper can be removed easily and the workability of the jam processing can be enhanced.

Since the joining member with the apparatus body provided in the moving body is provided on the lower end portion at the side that the user accesses for the jam processing of the moving body, it is not obstructive to the jam processing and the excellent workability of the jam processing can be maintained.

The support member for supporting the moving body such as a door in the open state is provided excluding a portion close to the upper end portion at the side that the user accesses for the jam processing of the moving body. Therefore, the support member of the moving body is not obstructive to the jam processing and the jam processing can be carried out easily.

In addition, the support member of the moving member is always provided on the almost lower end portion at the side that the user accesses for the jam processing of the moving body and at least three support members are provided on the opposite side thereof. Therefore, a stable support state can be maintained so that the generation of troubles and looseness can be prevented.

Moreover, the consistency of the moving body and the apparatus body is enhanced. Therefore, functional components such as the sheet guide member provided integrally with the moving body and the branching member of the conveying path are accurately placed in the predetermined positions of the apparatus body when the moving body is closed. Consequently, a stable function can be guaranteed.

In the state in which the door is opened, furthermore, the branching member is caused to automatically take such an attitude as to enlarge the space for jam processing. Therefore, the outer dimension of the apparatus body can be reduced when the door is opened. Accordingly, a sufficient space for jam processing can be maintained without requiring a large installation space for the apparatus body. Thus, the workability of the jam processing can be enhanced.

In such a simple structure that the branching member side abutting member is caused to abut on the body side abutting member interlockingly with the closing operation of the door, the branching member can be caused to take an action attitude when the door is closed.

In such a simple structure that the branching member automatically takes an attitude to enlarge the space for jam processing by a self-weight thereof in the state in which the door is opened, the space for jam processing can be enlarged effectively.

The branching member side abutting member and the body side abutting member are provided on the opposite side of the side that the user accesses for the jam processing of the apparatus body. Therefore, the branching member side abutting member and the body side abutting member are not obstructive to the jam processing work. Consequently, the workability of the jam processing can be enhanced still more.

In the above description, the sheet-like object conveying apparatus according to the present invention is mainly provided in an image forming apparatus such as a copying machine, a printer or a facsimile, and is applied to a sheet-like object conveying apparatus for conveying a sheet-like object, for example, a plain paper, a transparent film for OHP or the like by means of a plurality of guide members. However, it is apparent that the sheet-like object conveying apparatus according to the present invention can be widely applied to an apparatus for conveying a sheet-like object such as an apparatus for conveying a sheet-like bag for filling medicines, foods and the like or a conveying apparatus for sorting a postcard and an envelope.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A sheet-like object conveying apparatus, comprising:

an apparatus body provided with, on one of side surfaces, a conveying path for conveying a sheet-like object in a longitudinal direction; and a moving body which is movable between a first position in which said moving body is to be joined with said apparatus body such that the sheet-like object can be conveyed to cover said conveying path and a second position apart from said apparatus body in order to expose said conveying path; wherein when said moving body is placed in said second position, one side portion, which is required for an operation in said conveying path, close to an upper end between said moving body and said apparatus body is brought into an open state.

2. A sheet-like object conveying apparatus, comprising:

an apparatus body provided with, on one of side surfaces, a conveying path for conveying a sheet-like object in a longitudinal direction;

a moving body which is movable between a first position in which said moving body is to be joined with said apparatus body such that the sheet-like object can be conveyed to cover said conveying path and a second position apart from said apparatus body in order to expose said conveying path; and a support member for supporting one of sides in which the other side in a direction orthogonal to a direction of movement of said moving body in a portion close to an upper end of said moving body is to be brought into an open state and both sides in the direction orthogonal to the direction of said movement of said moving body in a portion close to a lower end of said moving body respectively, and for causing said moving body to be moved in an almost horizontal direction between said first and second positions with respect to said apparatus body.

3. The sheet-like object conveying apparatus as set forth in claim 2, further comprising a joining member provided on said other side portion in the portion close to the lower end of said moving body in order to join said moving body with said apparatus body when said moving body is placed in said first position.

4. A sheet-like object conveying apparatus, comprising:

an apparatus body provided with, on one of side surfaces, a conveying path for conveying a sheet-like object in a longitudinal direction;

a moving body which is movable between a first position in which said moving body is to be joined with said apparatus body such that the sheet-like object can be conveyed to cover said conveying path and a second position apart from said apparatus body in order to expose said conveying path; and a support member for causing said moving body to be moved in an almost horizontal direction with respect to said apparatus body in at least three places in which one side portion in a direction orthogonal to a direction of movement of said moving body required for an operation in said conveying path in a portion close to an upper end of a space formed between said moving body and said apparatus body when said moving body is placed in said second position is excluded, and one place close to a lower portion on said one side portion of said moving body and two different places in a vertical direction of the other side portion are included.

5. The sheet-like object conveying apparatus as set forth in claim 4, further comprising a fixing member provided on one side portion in the direction orthogonal to the direction of the movement of said moving body in the portion close to the lower end of said apparatus body in order to join said moving body with said apparatus body when said moving body is placed in said first position.

* * * * *